US012331610B1

(12) United States Patent
Walker et al.

(10) Patent No.: US 12,331,610 B1
(45) Date of Patent: Jun. 17, 2025

(54) TUBING HEAD SPOOLS WITH ORIENTATION FEATURE

(71) Applicant: Baker Hughes Energy Technology UK Limited, Bristol (GB)

(72) Inventors: David John Robert Walker, Ellon (GB); Scott Macdonald, Kirkcaldy (GB); Darren Hatton, Aberdeen (GB)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 18/799,869

(22) Filed: Aug. 9, 2024

(51) Int. Cl.
*E21B 33/038* (2006.01)
*E21B 33/043* (2006.01)
*E21B 41/04* (2006.01)

(52) U.S. Cl.
CPC ..... *E21B 33/038* (2013.01); *E21B 33/043* (2013.01); *E21B 41/04* (2013.01)

(58) Field of Classification Search
CPC ..... E21B 33/038; E21B 33/043; E21B 41/04
See application file for complete search history.

(56) References Cited

U.S. PATENT DOCUMENTS

| | | | | |
|---|---|---|---|---|
| 7,500,524 | B2 * | 3/2009 | Hopper | E21B 33/0353 166/88.1 |
| 11,286,739 | B2 * | 3/2022 | June | E21B 23/02 |
| 11,668,151 | B2 | 6/2023 | Bourgeois et al. | |
| 11,732,538 | B2 | 8/2023 | Hosie et al. | |
| 11,834,918 | B2 * | 12/2023 | Mclaughlin | E21B 33/043 |
| 11,885,194 | B2 * | 1/2024 | Murphy | E21B 33/043 |
| 12,006,780 | B2 * | 6/2024 | Murphy | E21B 33/035 |
| 2004/0140125 | A1 * | 7/2004 | Dezen | B01D 17/06 166/348 |
| 2007/0034379 | A1 * | 2/2007 | Fenton | E21B 19/002 166/368 |
| 2009/0211761 | A1 * | 8/2009 | Broussard | E21B 33/0422 166/368 |
| 2012/0193104 | A1 * | 8/2012 | Hoffman | E21B 33/035 166/348 |
| 2015/0259990 | A1 * | 9/2015 | June | E21B 33/038 166/341 |
| 2023/0130315 | A1 * | 4/2023 | Anderson | E21B 47/06 166/341 |

FOREIGN PATENT DOCUMENTS

| | | | | |
|---|---|---|---|---|
| AU | 2008201072 | A1 | 4/2008 | |
| GB | 2171737 | A * | 9/1986 | E21B 33/035 |
| GB | 2397312 | A * | 7/2004 | E21B 33/035 |
| GB | 2484809 | A * | 4/2012 | E21B 33/0355 |
| WO | WO-03067017 | A2 * | 8/2003 | E21B 19/002 |
| WO | WO-2014028365 | A2 * | 2/2014 | E21B 33/038 |

* cited by examiner

*Primary Examiner* — Aaron L Lembo
(74) *Attorney, Agent, or Firm* — Hogan Lovells US LLP

(57) ABSTRACT

A system to be used with a subsea well or completion installation can include a non-oriented tubing hanger adapter bushing (THAB) to be associated with a sleeve and a full-bore tubing head spool (FBTHS) of the subsea well or completion installation. An externally activated key of the FBTHS can engage with a helical groove associated with the sleeve and with the non-oriented THAB to enable self-orientation of a tubing hanger independent of an external orientation application based in part on a blowout preventer (BOP).

20 Claims, 7 Drawing Sheets

TUBING HEAD SPOOLS WITH ORIENTATION FEATURE

BACKGROUND

1. Field of Invention

At least one embodiment is related in subsea completion systems or installations in offshore operations.

2. Description of the Prior Art

A subsea well or completion installation may include subsea equipment and infrastructure to support hydrocarbon production and other features associated with an offshore well. Aspects of the subsea well or completion installation may include assembly of casings, tubing, hangers, valves, and control systems that may reside on or close to a seabed, and may be associated with one or more individual wellheads associated with different wells. On the surface side, such a subsea well or completion installation may couple a well to a processing or storage facility for any hydrocarbons generated from the well. However, such subsea well or completion installation may require temporary abandonment, removal, or multiple runs or trips of blowout preventer (BOP) stack to install a tubing head spool for a tubing hanger. As such, there may be a requirement for removal and reinstallation of the BOP stack, which may require such multiple trips of the BOP during a subsea well or completion installation.

SUMMARY

In at least one embodiment, a system for a subsea well or completion installation herein includes a non-oriented tubing hanger adapter bushing (THAB) associated with a sleeve and a full-bore tubing head spool (FBTHS) of the subsea well or completion installation. An externally activated key of the FBTHS is to engage with a helical groove associated with the sleeve and with the non-oriented THAB to enable self-orientation of a tubing hanger independent of an external orientation application based in part on a blowout preventer (BOP) or a running system.

In at least one embodiment, a method to be used with a subsea well or completion installation herein includes providing a non-orientated THAB associated with a FBTHS of the subsea well or completion installation. The method also includes using an externally activated key of the FBTHS to engage with a helical groove associated with the sleeve and with the non-oriented THAB to enable self-orientation of a tubing hanger independent of an external orientation application based in part on a BOP or a running system.

In at least one embodiment, an externally activated key of a FBTHS herein is to engage with a helical groove associated with a sleeve and a non-orientated THAB. An interaction of the helical groove and the externally activated key is to enable self-orientation of a tubing hanger independent of an external orientation application which is based in part on a BOP or a running system.

BRIEF DESCRIPTION OF THE DRAWINGS

Various embodiments in accordance with the present disclosure will be described with reference to the drawings, in which.

DETAILED DESCRIPTION

Figure 1:
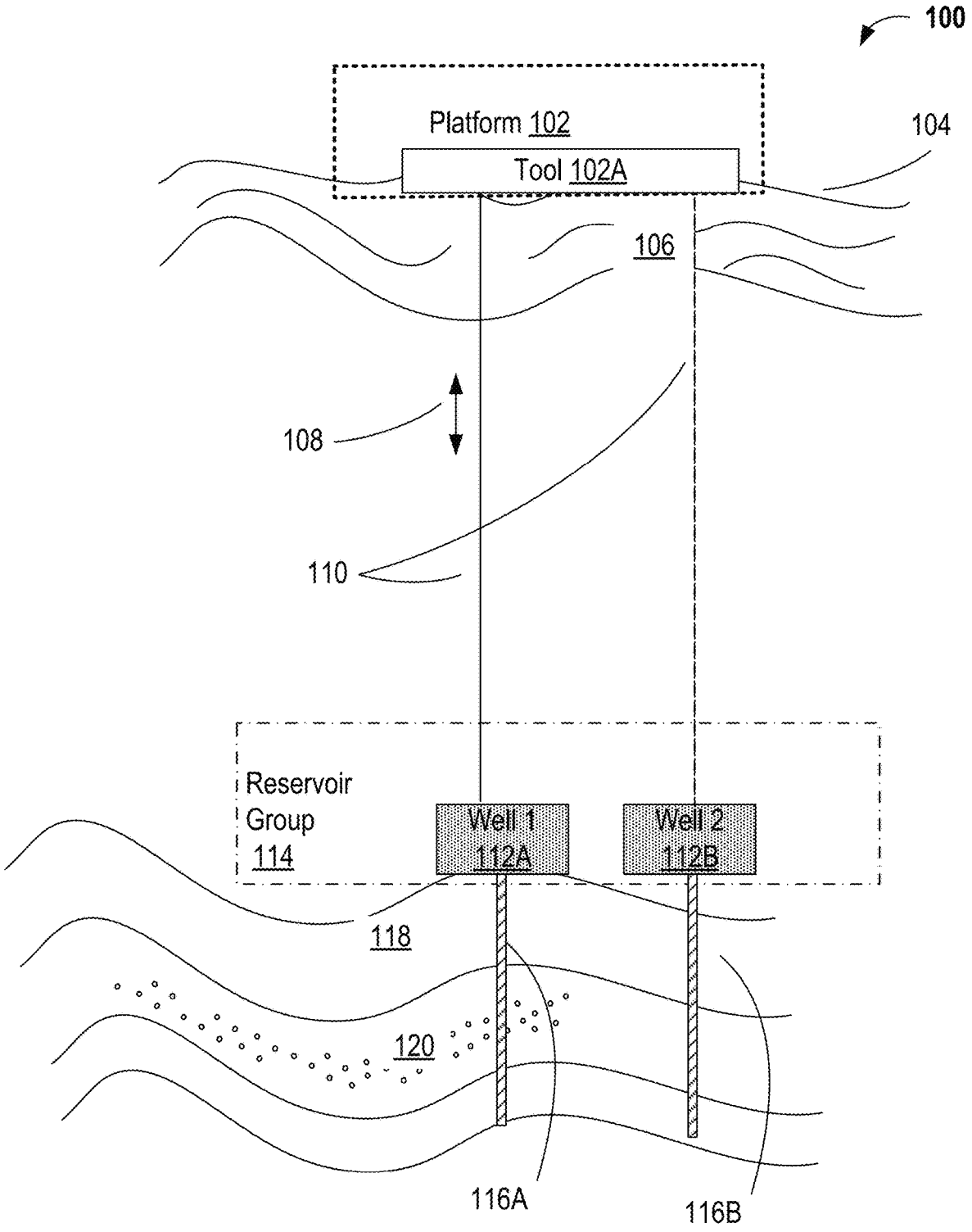
FIG. 1 illustrates an example system subject to a single-trip BOP in a subsea well or completion installation using an externally activated key of a full-bore tubing head spool (FBTHS), according to aspects of at least one embodiment herein.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In at least one embodiment, to address one or more of such issues described throughout herein, a single-trip blowout preventer (BOP) provision in a subsea well or completion installation may be provided as part of a customer's offshore operations. A BOP provision may include multiple trips which are individually expensive, but can be reduced with the described single-trip BOP provision in a subsea well or completion installation. Instead, the single-trip BOP provision herein may be used with a drill-through or full-bore Tubing Head Spool (FBTHS) having a full-bore of 18¾" at the spool. The FBTHS may not have stepped reductions in an inner circumference diameter. In at least one example, the FBTHS may have an inner circumference diameter that may be between 16" to 19" and such an inner circumference diameter may be throughout the FBTHS without steps to land feature thereon. However, the use of the FBTHS with the non-oriented THAB, the sleeve with a helical groove, and an externally activated key may allow drilling and completion of subsea wells and may remove from a requirement for temporary abandonment and removal and re-installation of BOP stacks.

In one example, a non-orientated tubing hanger adapter bushing (THAB) may include an outer circumferential surface. The outer circumferential surface may be provided to fit within FBTHS. One or more hang-offs may be provided in the system herein. For instance, a hang-off may be provided for a non-oriented THAB so that a sleeve may be provided within the non-oriented THAB. The hang-off may include multiple locking dogs as engagement features that can extend radially outward to engage between the non-oriented THAB and the FBTHS, where the sleeve is supported within non-oriented THAB. An externally activated key may support self-orientation of a tubing hanger in the subsea well or completion installation, without additional orientation equipment or means so that the self-orientation of the tubing hanger is independent of an external orientation application based in part on a BOP or a running tool.

In one example, a tubing hanger may be associated with the sleeve, then a helical groove of the sleeve interacts with the externally activated key for the self-orientation of the sleeve and the associated tubing hanger. Therefore, the self-orientation aspect of the subsea well or completion installation herein is enabled within a full-bore well access using at least the combination of the sleeve with the helical groove, the non-oriented THAB, the FBTHS and the externally activated key provided in association with the FBTHS, which is irrespective of the BOP or running system. As the FBTHS is irrespective of the BOP or running system, the FBTHS with the externally activated key may be permanent or may remain attached to a wellhead throughout the life of an underlying well, without a need for multiple trips or runs to retrieve and reinstall at least the externally activated key.

Further, an external orientation application that is avoided herein may be in reference to a use of a BOP orientation pin, snap key device, or a running system that may not be used in the subsea well or completion installation herein. In one example, a snap key could act within a subsea well or completion installation. However, the snap key would require surface manipulation by, for instance, physical rotation of a completion string until there is resistance. The resistance may be assumed to be a key that has snapped into place. However, the snap key may be used in shallow water only. Nevertheless, the snap key still represents an external orientation application based in part on a BOP or a running tool that is avoided in the present subsea well or completion installation. Instead, an interaction between the externally activated key and the helical groove of a sleeve within a non-oriented THAB provides the orientation that is independent of the external orientation application that may be based in part on a BOP or a running system.

As there is no need for a BOP orientation pin or snap key device, there is no need for a BOP to be part of multiple trips to a wellhead. Instead, the system herein supports a single-trip BOP provision in a subsea well or completion installation, as part of drilling and completion operations for one or more wells. A FBTHS may include an inner circumferential surface with a first diameter to facilitate passage of one or more wellbore components. For example, a non-orientated THAB may include an outer circumferential surface that is sized to fit within the THS.

The subsea well or completion installation herein enables a reduction in offshore operations by at least removal of a double trip for a BOP, but also by allowing self-alignment and self-orientation operations using the externally activated key. As such, there is no external requirements to cause orientation of at least a tubing hanger, which may otherwise require use of a BOP in an additional operations of the double trip for the BOP. In at least one example, to support the single trip operation, mounting of an orientation pin to a BOP or a running system that may also require a separate orientation running tool or that may require the use of multiple helical interfacing sleeves may be disadvantaged by cost factors, tool specifications, and number of BOP-related operations.

FIG. 1 illustrates an example system 100 subject to a single-trip BOP in a subsea well or completion installation using an externally activated key of a tubing head spool (FBTHS), according to aspects of at least one embodiment herein. The system 100 may include a platform 102 that may be a floating or fixed (such as, anchored or jack-up) structure associated with a water surface 104 of a water environment 106. The platform 102 may be a base for subsea well or completion installation and other operations for extracting and processing oil and gas. The platform 102 may be associated with a well production or injection tree for controlling the flow of hydrocarbons or other media (such as $CO_2$, produced water) from or to the well. The platform 102 may include valves, chokes, and other equipment for regulating and monitoring production. Further, the platform 102 may include an Xmas or production tree, a BOP stack, a tubing hanger, a non-oriented THAB, a FBTHS, a sleeve, an externally activated key of the FBTHS, and other components suitable for the subsea well or completion installation.

The system 100 may be associated with one or more wellheads installed for one or more wells 112A, 112B using wireline, cables, or other features 110. Further, the wireline, cables, or other features 110 may be used to run 108 one or more of the Xmas or production tress, a BOP stack, tubing hanger, a non-oriented THAB, a FBTHS, a sleeve, and other components suitable for the subsea well or completion installation, from a platform 102 to the seabed 118 or subterranean area 120 under the seabed 118. In at least one embodiment, the externally activated key with the FBTHS may form a permanent feature of the subsea well or completion installation and completion system herein by remaining attached to the wellhead throughout the life of an underlying well. The wellhead, as detailed with respect to at least FIG. 2, may be connection between a wellbore 116A; 116B of a well 112A; 112B and the Xmas or production tree and may also include one or more seals to secure the well during the various runs 108 performed thereon. The wellbore 116A; 116B may be in a subterranean area 120 and under a seabed 118. The wells 112A, 112B may be part of a reservoir group 114.

Further, the system 100 may include one or more manifolds which may be provided structures to connect multiple wells 112A-112B to a flowline for production and for transportation of applied fluids and production fluids to and from the wells. The system 100 may include flowlines and umbilical features that may be pipes to transport hydrocarbons as part of the production fluid and to transport hydraulic oil, mud, or other fluids as part of the applied fluids between the platform 102 and a well 112A; 112B. The umbilical features are generally represented by lines 110 and can also support electrical lines for electrical signals between the subsea well or completion installation and the platform 102. Further, while illustrated to be an offshore platform, the platform 102 illustrated can communicate or be coupled to an onshore facility or may be an onshore facility by itself.

The platform 102 may include subsea control features to monitor and control the subsea well or completion installation. In one example, the platform 102 may include subsea control features to control a wireline, cables, or other features 110 and to control a remotely-operated vehicle (ROV) and any other subsea control modules. Further, the subsea well or completion installation herein may be associated with subsea completions, drilling operations, temporary or long-term abandonment, carbon capture, and other operations. The subsea well or completion installation may be part of further system to perform any of such operations.

Figure 2:
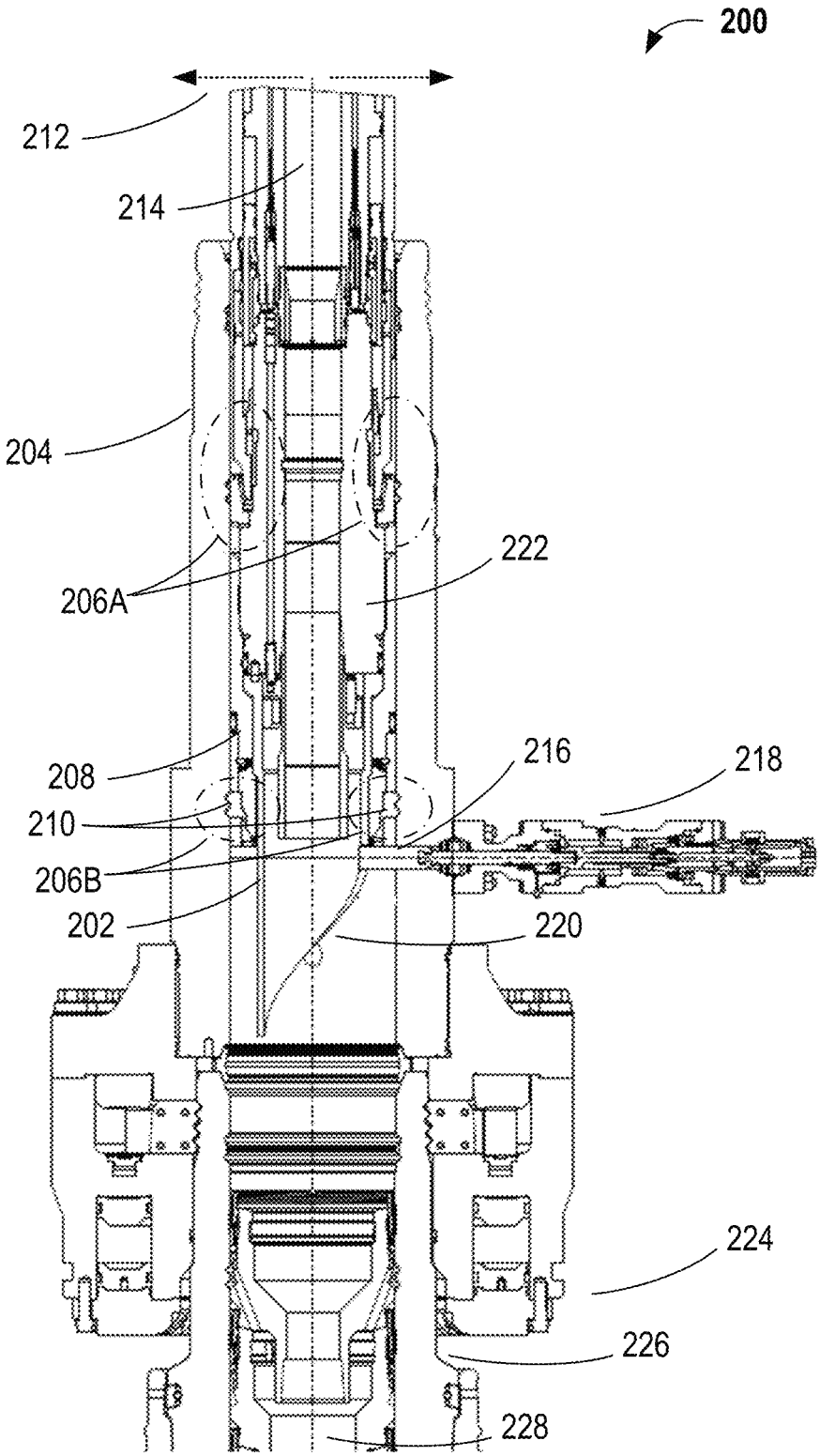
FIG. 2 illustrates a system of a wellhead after a single-trip BOP in a subsea well or completion installation and having installed therein a non-oriented tubing hanger adapter bushing (THAB) and a FBTHS, with an externally activated key, in accordance with at least one embodiment.

FIG. 2 illustrates a system 200 of a wellhead after a single-trip BOP in a subsea well or completion installation and having installed therein a non-oriented THAB and a FBTHS with an externally activated key, in accordance with at least one embodiment. As illustrated, the system 200 may be performed on any of the wells 112A-112B of FIG. 1, with support from a platform 102 and using one or more runs 108 for a subsea well or completion installation. The system 200 may include a non-oriented THAB 208 and a sleeve 202 to be associated with a FBTHS 204 of the subsea well or completion installation.

The subsea well or completion installation, as used herein, may be a representation of at least part of the system 200 having the FBTHS 204, the non-oriented THAB 208, and other details included herein. The system 200 may have other features but that are not detailed herein, such as the system may also include sealing of the non-oriented THAB 208 to the FBTHS 204. However, this sealing may not be required for all subsea well or completion installation. Further, as used herein, a non-oriented THAB 208 may be in reference to a THAB that has no orientation indicated by itself. For instance, there may be no features or indication provided to the non-oriented THAB 208 to allow its orientation as an independent component within the subsea well or completion installation and to support orientation of any further component that may be associated with it.

The system 200 may include one or more hang-offs 206A, 206B. As used herein, a hang-off 206A, 206B may be a mechanical connector for suspending a portion or further components of a subsea well or completion installation therefrom. A hang-off may be used with a non-oriented THAB 208 or a drill string that may be a tubing, when a weight of the tubing is to be suspended below or independent of a BOP. In one example, a lower one of the hang-offs 206B may be provided for a non-oriented THAB 208 and may include multiple locking dogs 210. The lock dogs may be engagement features that can extend radially outward 212, relative to an axis 214 of a wellbore 116A; 116B. The extension is to engage, the locking dogs 210, between the non-oriented THAB 208 and the FBTHS 204. Further, the non-oriented THAB 208 may be used to support the sleeve 202 therein. The system 200 may include an externally activated key 216 that may be part of additional components to allow for an external trigger by an ROV or a hydraulic line, as detailed further in one of FIGS. 3-5 herein.

In at least one embodiment, the externally activated key 216 may be provided through the FBTHS 204 and may be provided to engage with a helical groove 220 associated with the sleeve 202 of the non-oriented THAB 208. The helical groove 220, although referred to as a groove and as used herein, may be a shape of a bottom end of a sleeve 202, which may be mounted to an underside of the tubing hanger 222. The tubing hanger 222 may interface with the sleeve 202 that is within the non-oriented THAB 208. This engagement between the helical groove 220 and the externally activated key 216 is to enable self-orientation of a tubing hanger 222 as the sleeve 202 is oriented by virtue of an interaction between the externally activated key 216 and the helical groove 220.

The self-orientation of a tubing hanger 222 can, therefore, occur independent of an external orientation application that may be based in part on a BOP or a running system. For instance, the FBTHS 204 may be provided with the externally activated key 216 and with its additional components during installation or positioning of the FBTHS 204 on a wellhead 226, as discussed further with respect to one or more of FIGS. 3-5 herein. In addition, the wellhead 226 may be associated with a FBTHS 204 by means of a high pressure connector 224.

The system 200 including the wellhead 226 may be such that the FBTHS 204 having the externally activated key 216 can be associated with the wellhead 226 prior to a BOP being applied thereto. The FBTHS 204 may remain with the wellhead 226, as detailed further in one or more of FIGS. 3-5, when the BOP or any running system is removed in one or more installation steps of the subsea well or completion installation. Therefore, in at least one embodiment, an externally activated key of a FBTHS is such that the externally activated key 216 can be used to engage with a helical groove 220 associated with the sleeve 202 of the non-orientated THAB 208. An interaction of the helical groove 220 and the externally activated key 216 is to enable self-orientation of a tubing hanger independent of an external orientation application which is based in part on a BOP or a running system.

The system 200 may also include or be associated with an ROV or a hydraulic line to control extension or retraction of the externally activated key 216. The ROV related operations is detailed further in one or more of FIGS. 3-5. Further, one or more of the FBTHS 204, the sleeve 202, and the non-oriented THAB 208 may be associated with a wellhead 226, based in part on an operation of the ROV. For instance, the FBTHS 204 may be placed over the wellhead 226 using support from the ROV, as detailed with respect to at least FIG. 3 herein. Separately, the sleeve 208 of the non-orientated THAB 208 may be associated with the wellhead 226 using the ROV or a hydraulic line to extend the externally activated key 216 for setting of the sleeve 202 within the FBTHS 204 of the wellhead 226 or for setting of the non-oriented THAB 208, including for orienting the sleeve 202 within the non-oriented THAB 208. This is as detailed with respect to at least FIGS. 4 and 5 herein.

Figure 3:
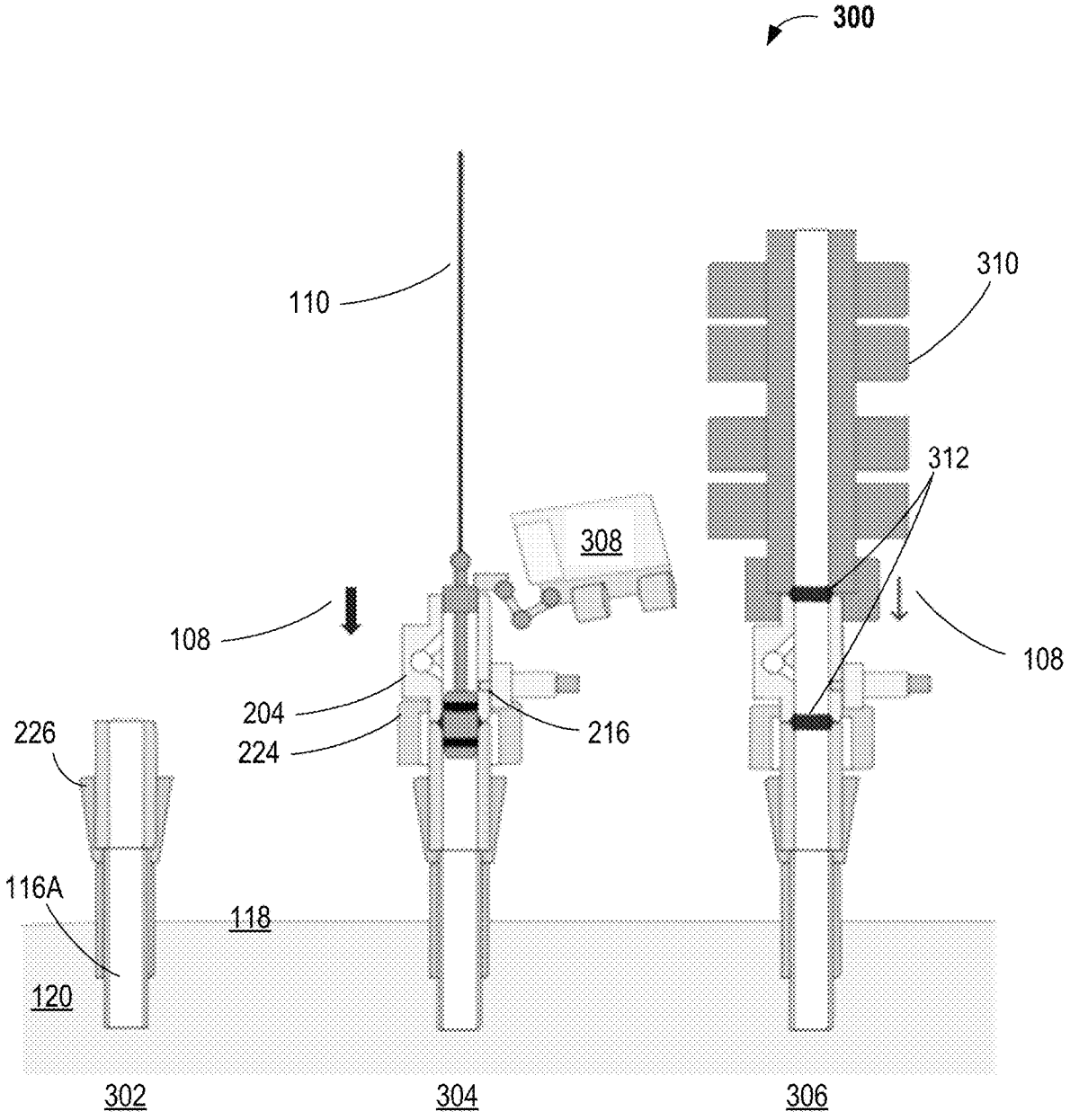
FIG. 3 illustrates example sequence for a single-trip BOP in subsea well or completion installation supported by an externally activated key of a FBTHS, in accordance with at least one embodiment.

The system 200 may be such that its subsea well or completion installation includes a casing installation for one or more casing 228 using the BOP, as detailed with respect to at least FIG. 3 herein. The subsea well or completion installation may also include a sleeve installation for a sleeve 202, using the BOP, as detailed with respect to at least FIG. 5 herein. The FBTHS 204 may be positioned prior to the casing installation. The sleeve installation for the sleeve 202 may be provided in a manner that allows the sleeve 202 to be within the non-oriented THAB 208.

The system 200 may be such that its subsea well or completion installation includes an installation for one or more casing 228 and for the tubing hanger 222 using the BOP, and may be such that the FBTHS 204 can be positioned prior to the installation of the one or more casing 228. The system 200 may be such that the non-oriented THAB 208 is positioned after the installation of the one or more casing 228. Further, the system 200 can have the externally activated key 216 retracted for at least the installation of the one or more casing 228. However, the externally activated key 216 may be extended for at least the installation of the tubing hanger. The installation of the tubing hanger 222 may include orienting the tubing hanger to an orientation of the sleeve 202 of the non-oriented THAB 208, as its helical groove 220 is guided by the externally activated key 216.

In at least one embodiment, the system 200 may include the wellhead 226 provided such that the sleeve 202, the non-oriented THAB 208, or FBTHS 204 are associated to the wellhead 226 based in part on an operation by a wireline tool, a cabling tool, or a drill pipe 102A. Further, the ROV or a hydraulic line of the system 200 enables the externally activated key 216 of the FBTHS 204 to be activated. Activation of the externally activated key 216, as used herein, is in reference to extending the externally activated key 216, based in part on an operation of the ROV or the hydraulic line. Deactivation of the externally activated key 216, as used herein, may be in reference to retracting the externally activated key 216.

Figure 4:
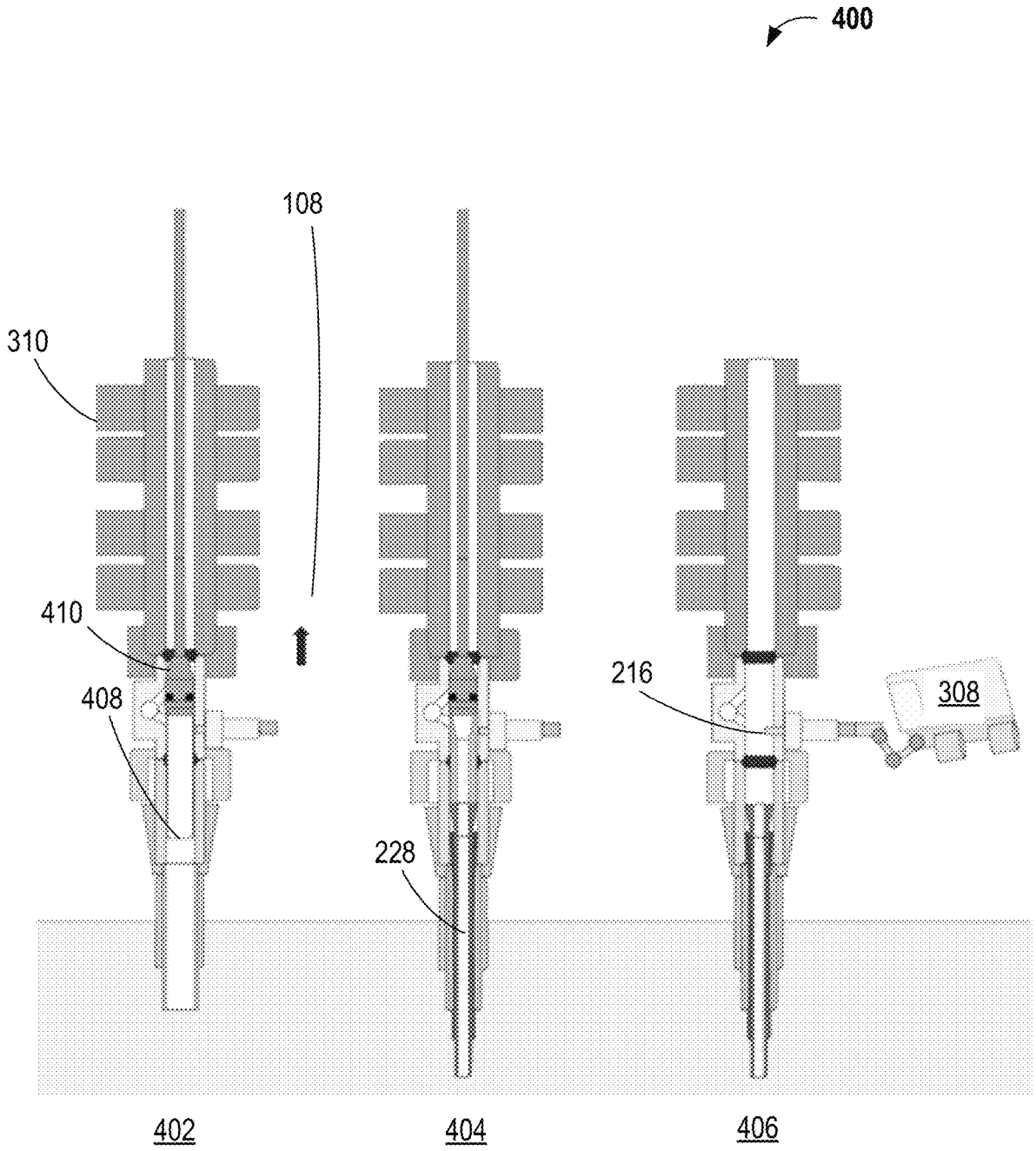
FIG. 4 illustrates further example sequence for the single-trip BOP in subsea well or completion installation supported by an externally activated key of a FBTHS, according to aspects of at least one embodiment herein.
Figure 5:
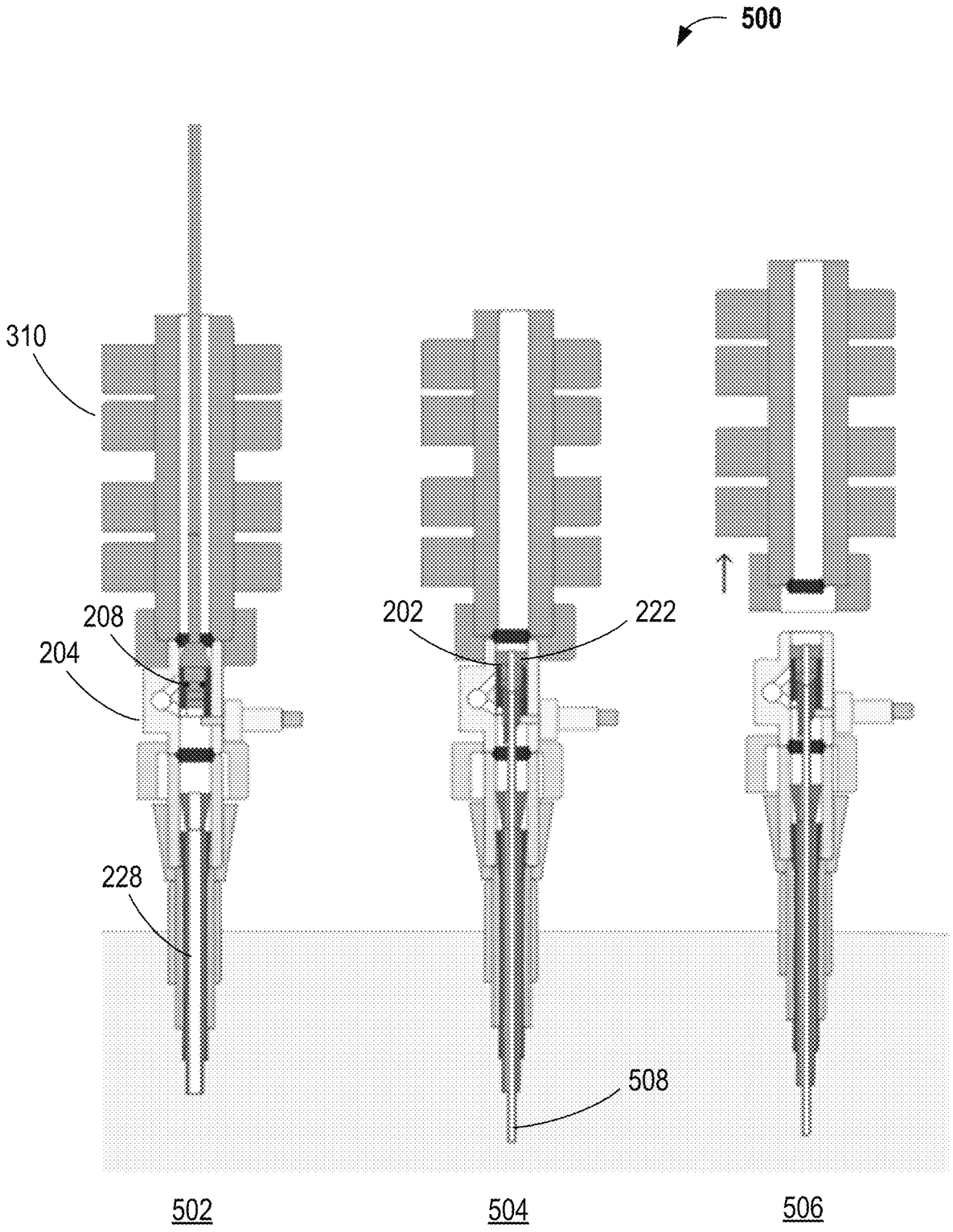
FIG. 5 illustrates example sequence to conclude a single-trip BOP in subsea well or completion installation supported by an externally activated key of a FBTHS, according to aspects of at least one embodiment herein.

The system 200 herein may also include one or more seals, as detailed in one or more of FIGS. 3-5 herein. The one or more seals may be associated with one or more of the sleeve 202, the non-oriented THAB 208, or the FBTHS 204, and may be so as to enable the BOP to perform operations above the sleeve, the THAB, and the FBTHS. Therefore, the externally activated key include capabilities to be retracted for at least the installation of the one or more casing in a wellhead underlying the FBTHS, and to be extended for at least the installation of a sleeve, the tubing hanger, or the non-oriented THAB, within the sleeve to be within the non-oriented THAB and the tubing hanger to be above the sleeve.

FIG. 3 illustrates an example sequence 300 for a single-trip BOP in subsea well or completion installation, in accordance with at least one embodiment. The example sequence 300 illustrate a first part 302 of the sequence of providing a wellhead 226 over a wellbore 116A in a subterranean 120 under a seabed 118. A second part 304 of the sequence may include using a wireline, cables, or other features 110 to lower, as part of a run or a trip 108, a FBTHS 204 to be associated to the wellhead 226. As illustrated, the FBTHS 204 is supported in the installation or positioning, as part of the association, using an ROV 308 or a hydraulic line. Further, as illustrated, a high pressure connector 224 provides at least part of the association between the FBTHS 204 and the wellhead 226.

FIG. 3 also illustrates a third part 306 of the sequence, as part of a further run or trip 108, to associate a BOP 310 with the FBTHS 204. This part of the sequence also illustrates that a system incorporating a single-trip BOP in subsea well or completion installation may include one or more seals 312. The one or more seals 312 may include a lower and an upper seal and may be associated with at least the FBTHS 204 to enable the BOP to perform operations above the THAB and the FBTHS. Further, FIG. 3 illustrates that the externally activated key 216 is retracted during and following installation of the FBTHS 204, till an ROV or a hydraulic line is used to activate the externally activated key 216 from a remote control room or unit located on a platform 102 or in association with the platform 102.

FIG. 4 illustrates a further example sequence 400 for the single-trip BOP in subsea well or completion installation, according to aspects of at least one embodiment herein. This further example sequence 400 may follow from the example sequence 300 of FIG. 3. This further example sequence 400 include a first sequence part 402 for a runner tool 410 to perform further runs or trips 108 for a liner 408. The runner tool 404 may be used through the seals 312 to provide the casing 228, as part of a second part 404 of the sequence. In each of such sequence parts 402, 404 of the sequence, as the installation of the FBTHS 204 is with the externally activated key 216, the externally activated key 216 remains retracted to allow for operations prior to any self-depth or self-orientation requirements in the system 100; 200.

FIG. 4 also illustrates that a third part 406 of the further example sequence 400 may include extending the externally activated key 216 by an activation performed by an ROV 308 or a hydraulic line. In this third sequence part 406, after the one or more casings 228 may be run 108 through the seals and through the externally activated key 216 in the retracted position, the externally activated key 216 is extended to allow for placement of the non-oriented THAB by self-depth placement performed and for placement of the sleeve with any tubing hanger associated therewith and with self-orientation performed. As the casings 228 and liner 408 are in place, the subsea well or completion installation can progress with the tubing hanger and the further sequence 500 in FIG. 5. In one instance, these further example sequence parts 402-406 may be fourth, fifth, and sixth parts for an overall sequence of single-trip BOP in subsea well or completion installation.

FIG. 5 illustrates yet a further example sequence 500 to conclude a single-trip BOP in subsea well or completion installation according to aspects of at least one embodiment herein. The example parts 502-506 of the sequence 500 may follow from the example sequence 400 of FIG. 4. The further example parts 502-506 of a sequence 500 may include a first part 502 for a runner tool 504 to perform further runs for placing a non-oriented THAB 208 in the FBTHS 204. The non-oriented THAB 208 may be placed at a predetermined depth guided by a feature of the non-oriented THAB 208 mating with some part of the externally activated key 216, in one example. This may represent a self-depth placement performed between the non-oriented THAB and the FBTHS. The runner tool 404 may be used through the seals 312 to provide the non-oriented THAB 208, and to provide a tubing hanger 222 with the sleeve 202 within the non-oriented THAB 208, as within a second part 504 of the sequence 500.

The sleeve 202 within the non-oriented THAB 208 may interface, at its helical groove 220, with the externally activated key 216, causing the tubing hanger 222 and the sleeve 202 to self-orient within the non-oriented THAB 208. Such self-orientation of the tubing hanger 222 is independent of an external orientation application based in part on a BOP 310 or a running system. The independence is at least because the externally activated key 216 is not part of the BOP or the running system that includes the running tool 410. For instance, the independence of the external orientation application may be at least because the self-orientation occurs without involvement of any orientation aspect or performance by the BOP 310 or the running tool 410, although the BOP 310 remains in position and the running tool 410 provides runs or trips including the installation of the sleeve and the non-oriented THAB. The running tool 410 may cause downward placement of the sleeve 202 but the orientation of the sleeve itself is not performed by the running tool 410 that has no orientation aspect in itself.

The tubing hanger 222 may be used to hang tubing 508, in at least one example. The BOP 310 may be removed in a third part 506 of the sequence. In one instance, these example parts 502-506 of the sequence may be seventh, eighth, and ninth steps for an overall sequence of single-trip BOP in subsea well or completion installation. Further, each of the example parts 302-506 in the sequences 300-500 of FIGS. 3-5 may be performed with additional sub-parts therebetween and with some changes to order but with a consistency of a running the BOP 310 once as a single-trip BOP in subsea well or completion installation.

Figure 6:
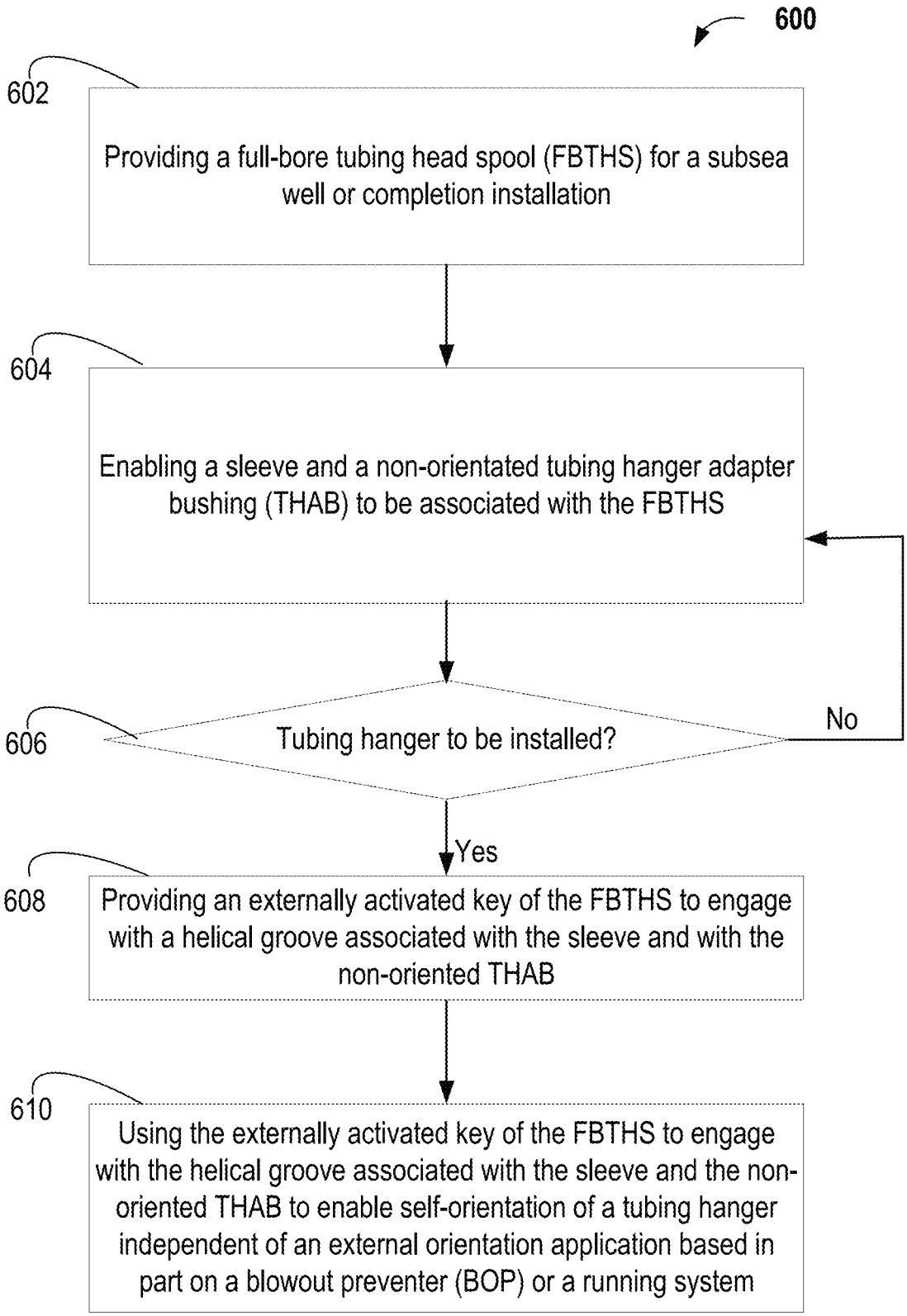
FIG. 6 illustrates a process flow for an example system or steps, as described with respect to one or more of FIGS. 1-5, in accordance with at least one embodiment.

FIG. 6 illustrates a process flow or method 600 for an example system or steps, as described with respect to one or more of FIGS. 1-5, in accordance with at least one embodiment. The method 600 may include providing 602 a FBTHS for the subsea well or completion installation. For instance, the FBTHS may be provided with a feature or provision for allowing therethrough an externally activated key. The method 600 may include preparing the FBTHS for running to a wellhead. As detailed with respect to at least FIG. 3, the FBTHS may be provided for the wellhead with an externally activated key associated within the FBTHS and with the externally activated key being in retracted position. The method 600 may include enabling 604 a sleeve and a non-oriented THAB to be associated with FBTHS of the subsea well or completion installation. This step may include ensuring that an outer circumferential surface of the non-oriented THAB may be provided to fit the FBTHS.

The method 600 may include verifying or determining 606 that the tubing hanger is to be installed for the subsea well or completion installation. The method 600 can include providing 608 an externally activated key of the FBTHS to engage with a helical groove associated with the sleeve and with the non-oriented THAB. For instance, the providing 608 step may be to extend the externally activated key form the FBTHS for the self-depth placement to be performed of the non-oriented THAB and for self-orientation to be performed of the tubing hanger in the FBTHS. In one instance, as illustrated in FIGS. 3-4, the sleeve of the non-oriented THAB may be provided with a tubing hanger as part of the providing 608 step or a separate sub-step associated therewith. One or more of steps 602-608 can represent the providing of a sleeve and of a non-orientated THAB to be associated with a FBTHS of the subsea well or completion installation.

The method 600 includes using 610 the externally activated key to enable self-orientation of a tubing hanger independent of an external orientation application based in part on a BOP or a running system. For example, the externally activated key can be activated in step 608 to be in the extended position. Then, running of the tubing hanger with the sleeve and within the non-oriented THAB can cause engagement of the externally activated key at the helical groove of the sleeve. This can cause self-orientation of the sleeve within the non-oriented THAB, and together with the tubing hanger, to an appropriate orientation that is predetermined based in part on location of at least the externally activated key and the helical groove of the sleeve. Further, as described with respect to FIG. 5, the method 600 is such that the self-orientation in step 610, of the tubing hanger, is independent of an external orientation application based in part on a BOP or a running system, at least because the self-orientation occurs without involvement of any orientation aspect or performance by the BOP or the running system, although the BOP or running system may remain in position during the self-orientation.

Figure 7:
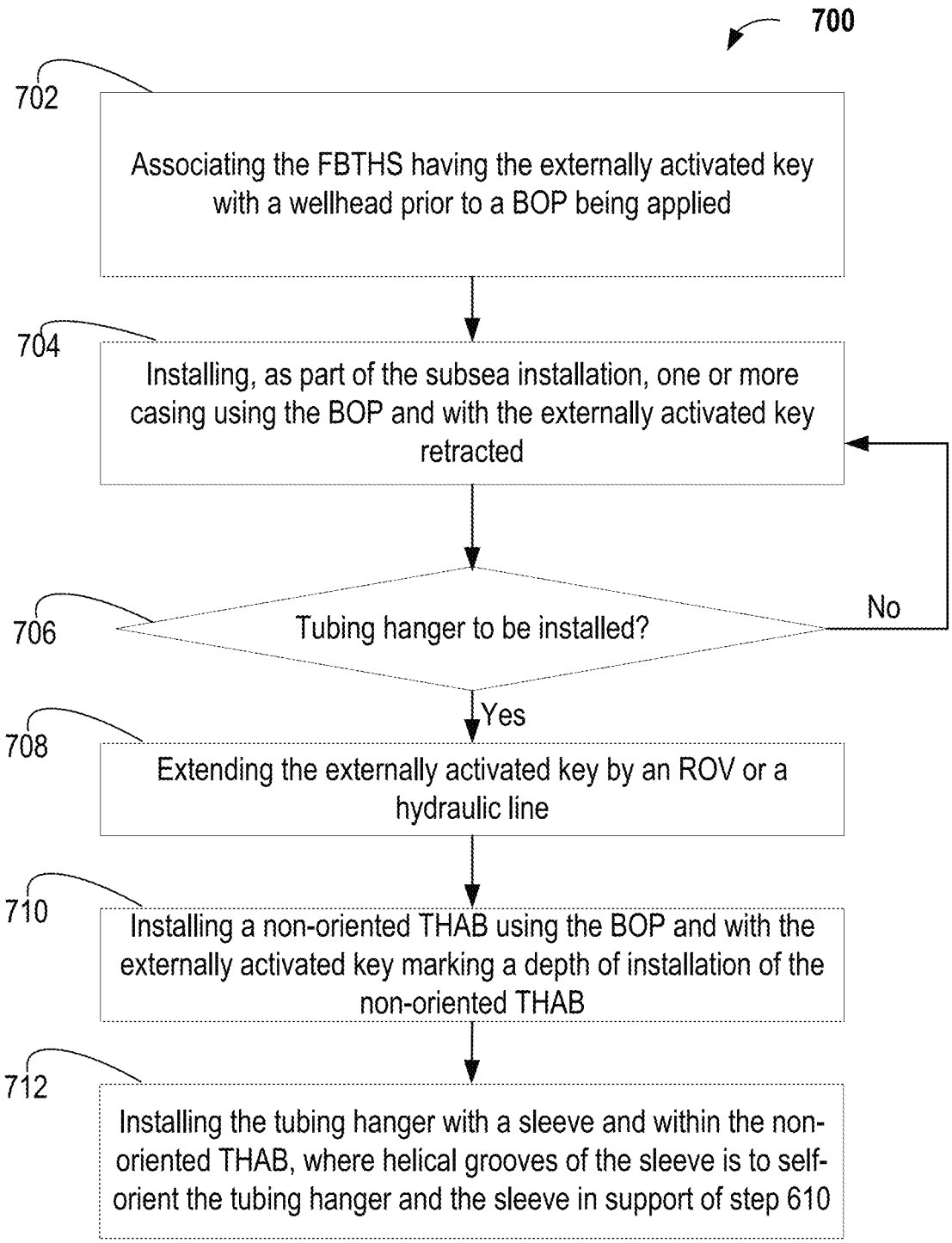
FIG. 7 illustrates another process flow for an example system or steps, as described with respect to one or more of FIGS. 1-5, in accordance with at least one embodiment.

FIG. 7 illustrates another process flow or method 700 for an example system or steps, as described with respect to one or more of FIGS. 1-5, in accordance with at least one embodiment. The method 700 of FIG. 7 may be used with the method 600 of FIG. 6. The method 700 in FIG. 7 may include associating 702 the FBTHS having the externally activated key (in a retracted position) with a wellhead prior to a BOP being applied. The method 700 may include installing 704, as part of the subsea well or completion installation, one or more casing using the BOP and with the externally activated key retracted. Further, the method 700 may verifying or determining 706 that the tubing hanger is to be installed for the subsea well or completion installation. This may be in support of step 606 in FIG. 6. The method 700 may include extending 708 the externally activated key by an ROV or a hydraulic line, which may be in support of step 610 of FIG. 6. The method 700 may include installing 710 a sleeve using the BOP and with the externally activated key marking a depth of installation of the non-oriented THAB. This is detailed further with respect to at least the parts of a sequence 500 in FIG. 5. The method 700 may include installing 712 the tubing hanger with the sleeve and within the non-oriented THAB, where at least one helical groove of the sleeve is to self-orient the tubing hanger and the sleeve in support of step 610.

In all of such methods 600, 700 herein, the FBTHS having the externally activated key is enabled to remain with the wellhead when the BOP is removed in one or more installation steps of the subsea well or completion installation. The methods of FIGS. 6 and 7 herein may include a further step or sub-step for providing an ROV or a hydraulic line to perform an operation wherein one or more of the sleeve, the FBTHS, or the non-oriented THAB are associated with a wellhead based in part on the operation of the ROV. For instance, the FBTHS may be placed over the wellhead using support from the ROV, as detailed with respect to at least FIG. 3 herein. Separately, the sleeve and the non-oriented THAB may be associated with the wellhead using the ROV or a hydraulic line to extend the externally activated key for setting of the non-oriented THAB and for setting of the sleeve, including for orienting the sleeve and the tubing hanger. This is as detailed with respect to at least FIGS. 4 and 5 herein.

The methods of FIGS. 6 and 7 herein may include a further step or sub-step for positioning the FBTHS and the non-oriented THAB over a wellhead as a step in the subsea well or completion installation. The methods of FIGS. 6 and 7 herein may include a further step or sub-step for providing a casing installation for one or more casing using the BOP, within the FBTHS, as part of the subsea well or completion installation and after the step of positioning the FBTHS but before positioning of the non-oriented THAB.

The methods of FIGS. 6 and 7 herein may include a further step or sub-step for positioning the FBTHS and the non-oriented THAB as part of the subsea well or completion installation and prior to installing a tubing hanger. The methods of FIGS. 6 and 7 herein may include a further step or sub-step for installing, as part of the subsea well or completion installation, one or more casing, a sleeve to be supported within the non-oriented THAB, where the tubing hanger is above the sleeve, and the installing is performed in part by the BOP. The tubing hanger may be installed over the sleeve.

The methods of FIGS. 6 and 7 herein may include a further step or sub-step for retracting the externally activated key for at least installation of the one or more casing. However, this step may be performed with the running of FBTHS having the externally activated key in the retracted position in anticipation of the running tool being used for the installing the liner and casing. The methods of FIGS. 6 and 7 herein may include a further step or sub-step for extending the externally activated key for at least installation of the sleeve, the non-oriented THAB, and tubing hanger.

The methods of FIGS. 6 and 7 herein may include a further step or sub-step for associating the non-oriented THAB and FBTHS to a wellhead based in part on an operation by a wireline tool or a cabling tool and as part of the subsea well or completion installation. The methods of FIGS. 6 and 7 herein may include a further step or sub-step for activating the externally activated key of the FBTHS to be extended based in part on an operation of an ROV or a hydraulic line. The methods of FIGS. 6 and 7 herein may include a further step or sub-step for associating one or more seals with one or more of the THAB or the FBTHS to enable the BOP to perform operations above the THAB and the THS.

The specification and drawings are, accordingly, to be regarded in an illustrative rather than a restrictive sense. It will, however, be evident that various modifications and changes may be made thereunto without departing from the broader spirit and scope of the disclosure as set forth in the claims. Further, any of the many embodiments disclosed here may be combined by a person of ordinary skill using the present disclosure to understand the effects of such combinations.

What is claimed is:

1. A system comprising a blowout preventer (BOP) or a running system and for use with a subsea well or completion installation, the system comprising:

a non-oriented tubing hanger adapter bushing (THAB) associated with a sleeve and a full-bore tubing head spool (FBTHS) of the subsea well or completion installation; and an externally activated key of the FBTHS to engage with a helical groove associated with the sleeve and with the non-oriented THAB to enable self-orientation of a tubing hanger independent of an external orientation application performable in part using the BOP or the running system.

2. The system of claim 1, further comprising a wellhead and wherein the FBTHS comprising the externally activated key is associated with the wellhead prior to the BOP being applied and wherein the FBTHS remains with the wellhead when the BOP is removed in one or more installation steps of the subsea well or completion installation.

3. The system of claim 1, further comprising a remotely-operated vehicle (ROV) and wherein one or more of the FBTHS, the sleeve, or the non-oriented THAB are associated with a wellhead based in part on an operation of the ROV or a hydraulic line.

4. The system of claim 1, wherein the subsea well or completion installation comprises a casing installation for one or more casing using the BOP and comprises a sleeve installation using the BOP, wherein the FBTHS is positioned prior to the casing installation, and wherein the sleeve installation is for the sleeve to be supported within the non-oriented THAB.

5. The system of claim 1, wherein the subsea well or completion installation comprises an installation for one or more casing and for the tubing hanger using the BOP, and wherein the FBTHS is positioned prior to the installation for the one or more casing and the non-oriented THAB is positioned after the installation for the one or more casing.

6. The system of claim 5, wherein the externally activated key is retracted for at least the installation of the one or more casing, and wherein the externally activated key is extended for at least the installation of the tubing hanger.

7. The system of claim 1, further comprising a wellhead and wherein the non-oriented THAB and FBTHS are associated to the wellhead based in part on an operation by a wireline tool, a cabling tool, or a drill pipe.

8. The system of claim 1, further comprising a remotely-operated vehicle (ROV) and wherein the externally activated key of the FBTHS is activated to be extended based in part on an operation of the ROV.

9. The system of claim 1, further comprising one or more seals to be associated with one or more of the non-oriented THAB or the FBTHS to enable the BOP to perform operations above the THAB and the THS.

10. A method for a system comprising a blowout preventer (BOP) or a running system and to be used with a subsea well or completion installation, the method comprising:

providing a non-orientated tubing hanger adapter bushing (THAB) associated with a sleeve and a full-bore tubing head spool (FBTHS) of the subsea well or completion installation; and using an externally activated key of the FBTHS to engage with a helical groove associated with the sleeve and with the non-oriented THAB to enable self-orientation of a tubing hanger independent of an external orientation application performable in part using the BOP or the running system.

11. The method of claim 10, further comprising:

associating the FBTHS comprising the externally activated key with a wellhead prior to the BOP being applied; and enabling the FBTHS to remain with the wellhead when the BOP is removed in one or more installation steps of the subsea well or completion installation.

12. The method of claim 10, further comprising:

providing a remotely-operated vehicle (ROV) to perform an operation wherein one or more of the FBTHS, the sleeve, or the non-oriented THAB are associated with a wellhead based in part on the operation of the ROV or a hydraulic line.

13. The method of claim 10, further comprising:

positioning the FBTHS and the non-oriented THAB over a wellhead as a step in the subsea well or completion installation; and providing a casing installation for one or more casing using the BOP, within the FBTHS, as part of the subsea well or completion installation and after the step of positioning the FBTHS but before positioning of the non-oriented THAB.

14. The method of claim 10, further comprising:

positioning the FBTHS and the non-oriented THAB as part of the subsea well or completion installation and prior to installing a tubing hanger; and installing, as part of the subsea well or completion installation, one or more casing, the sleeve supported within the non-oriented THAB, and the tubing hanger using the BOP, wherein the tubing hanger is installed over the sleeve.

15. The method of claim 14, further comprising:

retracting the externally activated key for at least installation of the one or more casing; and extending the externally activated key for at least installation of the sleeve, the non-oriented THAB, and tubing hanger.

16. The method of claim 10, further comprising:

associating the non-oriented THAB and FBTHS to a wellhead based in part on an operation by a wireline tool, a cabling tool, or a drill pipe, and as part of the subsea well or completion installation.

17. The method of claim 10, further comprising:

activating the externally activated key of the FBTHS to be extended based in part on an operation of a remotely-operated vehicle (ROV) or a hydraulic line.

18. The method of claim 10, further comprising:

associating one or more seals with one or more of the THAB or the FBTHS to enable the BOP to perform operations above the THAB and the THS.

19. An externally activated key of a full-bore tubing head spool (FBTHS), the externally activated key to engage with a helical groove associated with a sleeve and with a non-orientated tubing hanger adapter bushing (THAB), wherein an interaction of the helical groove and the externally activated key is to enable self-orientation of a tubing hanger independent of an external orientation application which is based in part on a blowout preventer (BOP) or a running system.

20. The externally activated key of claim 19, further comprising capabilities to be retracted for at least the installation of the one or more casing in a wellhead underlying the FBTHS, and to be extended for at least the installation of one or more of the sleeve, the non-oriented THAB to support the sleeve therein, or the tubing hanger.

* * * * *